US009739441B2

(12) United States Patent
Adams

(10) Patent No.: US 9,739,441 B2
(45) Date of Patent: Aug. 22, 2017

(54) LIGHT FIXTURE WITH CURVED FRAME

(71) Applicant: JST Performance, LLC, Gilbert, AZ (US)

(72) Inventor: Stephen P. Adams, Mesa, AZ (US)

(73) Assignee: JST Performance, LLC, Gilbert, AZ (US)

( * ) Notice: Subject to any disclaimer, the term of this patent is extended or adjusted under 35 U.S.C. 154(b) by 0 days.

(21) Appl. No.: 14/636,008

(22) Filed: Mar. 2, 2015

(65) Prior Publication Data

US 2016/0258598 A1 Sep. 8, 2016

(51) Int. Cl.
*F21V 7/00* (2006.01)
*F21S 8/10* (2006.01)

(52) U.S. Cl.
CPC ..... *F21S 48/328* (2013.01); *F21S 48/321* (2013.01); *F21S 48/115* (2013.01)

(58) Field of Classification Search
CPC ..... F21Y 2103/003; F21Y 2103/02; F21Y 2103/025; F21S 48/328; F21S 48/321; F21S 48/115
USPC ..... 362/516, 223, 237, 244, 249.02
See application file for complete search history.

(56) References Cited

U.S. PATENT DOCUMENTS 4,791,402 A 12/1988 Vaughn
4,816,968 A 3/1989 Yamada et al.
5,101,326 A * 3/1992 Roney ..... B60Q 1/2615 362/249.01
5,188,445 A 2/1993 Haun et al.
5,309,277 A * 5/1994 Deck ..... 359/387
5,373,426 A 12/1994 O'Sullivan
5,798,691 A 8/1998 Kao
5,988,840 A 11/1999 Wirtz
6,190,026 B1 2/2001 Moore
6,520,669 B1 2/2003 Chen et al.
6,561,690 B2 5/2003 Balestriero et al.
6,592,238 B2 7/2003 Cleaver et al.
6,986,597 B2 1/2006 Elwell
D526,430 S 8/2006 Hernandez et al.
7,095,318 B1 8/2006 Bekhor
7,163,320 B2 1/2007 Liu
7,217,004 B2 5/2007 Park et al.
D576,754 S 9/2008 Wang
7,695,164 B2 4/2010 Berben et al.
7,726,845 B2 6/2010 Zheng et al.
7,758,211 B2 7/2010 Zheng et al.
7,806,560 B2 * 10/2010 Schultz et al. ..... 362/249.02
(Continued)

*Primary Examiner* — Bryon T Gyllstrom

(57) ABSTRACT

A lighting fixture for protecting and mounting an array of light sources such as LED modules. The fixture includes a frame with a first surface that arcs or curves with an arc angle of between ten and fifty degrees and an arc length of between about ten to fifteen times the arc height. A plurality of LED modules including a lens and bonnet reflector are each functionally coupled against the first surface to direct a combination refracted and reflected beam pattern, the beam pattern of each LED module having a peak luminous intensity directed substantially normally from the first surface in front of and against which each LED module is functionally coupled. The peak luminous intensity of the combination refracted and reflected beam pattern associated with each LED module has a positive angle with respect to the combination refracted and reflected beam pattern from adjacently located LED modules.

29 Claims, 2 Drawing Sheets

(56) References Cited

U.S. PATENT DOCUMENTS

| | | | | |
|---|---|---|---|---|
| D642,302 | S | 7/2011 | Schiavone et al. | |
| D643,951 | S | 8/2011 | Cai | |
| 8,092,049 | B2 | 1/2012 | Kinnune et al. | |
| D653,783 | S | 2/2012 | Biro et al. | |
| 8,220,976 | B2 * | 7/2012 | Liu et al. | 362/373 |
| 8,246,219 | B2 | 8/2012 | Teng et al. | |
| 8,313,222 | B2 | 11/2012 | Kinnune et al. | |
| 8,317,369 | B2 | 11/2012 | McCanless | |
| 8,430,195 | B2 | 4/2013 | Jansen et al. | |
| 8,591,057 | B2 | 11/2013 | Kawabata et al. | |
| 8,888,306 | B2 | 11/2014 | Thomas et al. | |
| 2004/0170017 | A1 * | 9/2004 | Zhan et al. | 362/240 |
| 2008/0290357 | A1 * | 11/2008 | Lin et al. | 257/98 |
| 2009/0323342 | A1 * | 12/2009 | Liu | 362/249.02 |
| 2010/0073637 | A1 * | 3/2010 | Matsumoto et al. | 353/30 |
| 2010/0091507 | A1 | 4/2010 | Li et al. | |
| 2010/0328947 | A1 * | 12/2010 | Chang et al. | 362/249.02 |
| 2011/0176297 | A1 * | 7/2011 | Hsia et al. | 362/217.1 |
| 2011/0233568 | A1 * | 9/2011 | An | F21S 8/086 257/88 |
| 2013/0107519 | A1 * | 5/2013 | Kim et al. | 362/235 |
| 2014/0016313 | A1 * | 1/2014 | Adams | F21S 48/321 362/235 |
| 2014/0268771 | A1 * | 9/2014 | Heikman | 362/249.02 |

* cited by examiner

LIGHT FIXTURE WITH CURVED FRAME

This application is a continuation of U.S. patent application Ser. No. 13/741,307, filed on Jan. 14, 2013, which claims the benefit of U.S. Provisional Application No. 61/586,614 filed on Jan. 13, 2012.

BACKGROUND OF THE INVENTION

Field of the Invention

The present invention relates to exterior vehicle lighting.

Discussion of the Prior Art

Prior art exterior vehicle lighting is limited in the manner by which light is distributed from the light source. For example, one prior art light source comprises one or more lights oriented in a plane and directing light in one direction and relying on diffusers or lenses to distribute light in directions other than the one direction. Based on the above limitations of the prior art, it would be preferable to improve the distribution of light.

SUMMARY OF THE INVENTION

It is an object of the invention to provide a lighting fixture for protecting and mounting an array of light sources such as Light Emitting Diode (LED) modules. The fixture includes a frame with a first surface that arcs or curves with an arc angle of between ten and fifty degrees and an arc length of between about ten to fifteen times the arc height. A plurality of LED modules including a lens and bonnet reflector are each functionally coupled against the first surface to direct a combination refracted and reflected beam pattern, the beam pattern of each LED module having a peak luminous intensity directed substantially normally from the first surface in front of and against which each LED module is functionally coupled. The peak luminous intensity of the combination refracted and reflected beam pattern associated with each LED module has a positive angle with respect to the combination refracted and reflected beam pattern from adjacently located LED modules.

The light fixture of the current invention fulfills the objective of producing a plurality of combination refracted and reflected beam patterns associated with each LED module and wherein each of the combination refracted and reflected beam patterns is directed substantially normal to the first surface of the frame behind and adjacent to each LED module. The resulting composite beam pattern comprised of the combination refracted and reflected beam pattern has a substantially uniform luminous intensity at angles within the arc angle of the fixture.

Objectives are fulfilled by the invention including the enhanced distribution of light from a combination beam light source without having to use a diffuser or a lens shape that also diminishes the intensity or brightness of a light source as it spreads or distributes light. Accordingly, the present invention is particularly useful as a spot light that distributes with equal intensity in a radial pattern.

DESCRIPTION OF THE INVENTION AND/OR EMBODIMENTS

Figure 1:
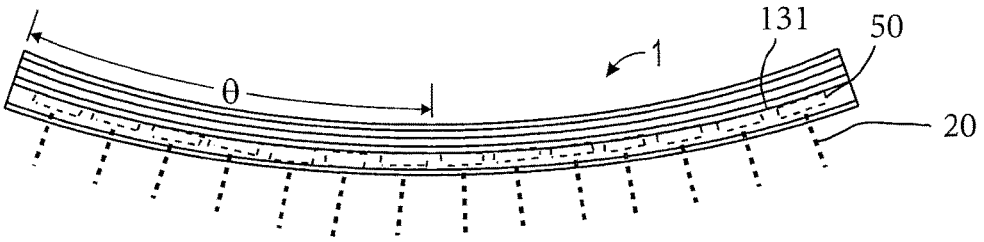
FIG. 1 illustrates a top view of an embodiment of the invention.

The invention comprises a curved frame for use as a lighting fixture for protecting and mounting a plurality of light sources on a vehicle or other transportation. FIG. 1 is a top view of a preferred curvature or arc angle "Θ" of the frame 1. An exemplary light source using the frame 1 includes an array of distinct light sources such as LED modules 50 oriented to direct and distribute light 20 radially in a semi-circumferential pattern from the frame 1 in the direction of the arc. The LED modules 50 may include at least one LED and at least one other LED module component such as a reflector, an LED driver, an LED lens, or an LED housing. A plurality of thermal fins 11 extend from the back of the curved backplane 131 to dissipate heat from the electronics within the frame 1.

Figure 2:
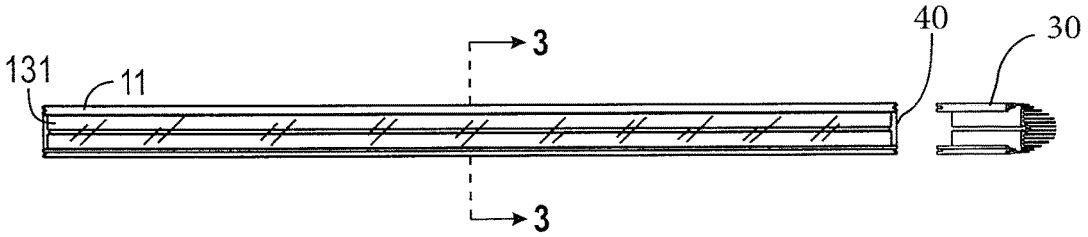
FIG. 2 illustrates a front view with a cutaway portion.

The frame 1 provides both structural support for the LED modules and thermal management. A preferred electronics frame is composed of metal and has a first side with a substantially smooth or planar surface and a second side with fins 111 for heat dissipation. FIG. 2 illustrates a front view of the frame 1 and the interior surface or curved backplane 131 against which the LED modules are coupled. LED modules are arranged in an array comprising one or more rows of LED modules coupled against the curved backplane 131.

Figure 3:
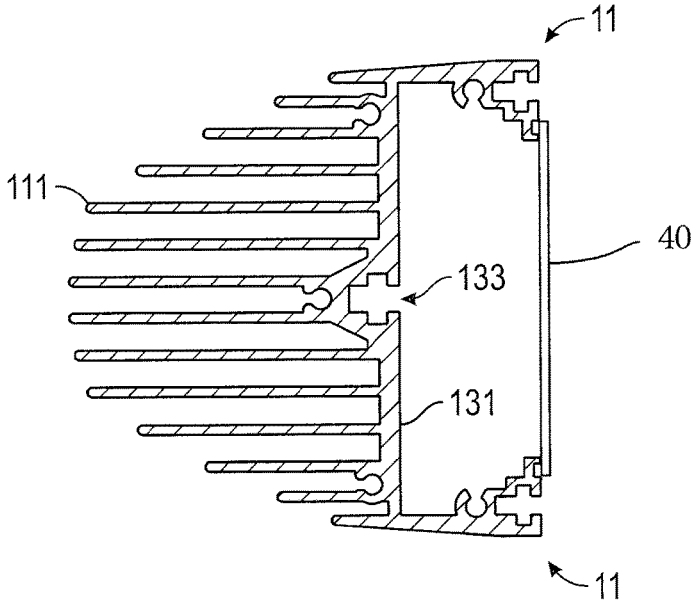
FIG. 3 illustrates a cross section.

FIG. 3 illustrates a cross section of the curved frame 1. A curved perimeter ridge 11 extends from either side of the curved backplane 131 for the length of the frame 1 and provides a cavity, channel or recess within which the LED modules are secured and protected. A protective lens 40 constructed from a sturdy and abrasion resistant material such as polycarbonate is mechanically coupled to the perimeter ridge 11 and defines a cavity within which the LED control electronics are secured and sets the lens off from the curved frame 1 and the LED modules within cavity defined by the curved backplane 131 and the curved perimeter ridge 11. The protective lens 40 can be either clear or incorporate one or more lens designs to focus or collimate or diffuse or direct light in a desired direction from the frame 1.

The preferred curved backplane 131 includes a backplane trough 133 defined by at least one surface separated from, and substantially parallel to, the curved backplane 131 surface. The illustrated trough 133 is equidistant from either perimeter ridge 11 but can be offset from the center. The at least one surface of the backplane trough 133 is a biasing surface against which fasteners can bias for securing LED modules or circuit boards to the backplane 131. As illustrated in FIG. 3, the preferred backplane trough 133 as viewed from a cross section resembles a negative image of a "+" or "t" shape and comprises five surfaces substantially parallel to the curved backplane 131 and six surfaces substantially perpendicular to the curved backplane 131. Nut-type fasteners are slid into the trough from the ends of the frame 1 and oriented to be engaged by bolt or screw type fasteners from a direction substantially perpendicularly to the backplane 131 and engage and bias to secure circuit boards placed against the backplane 131.

Figure 4:
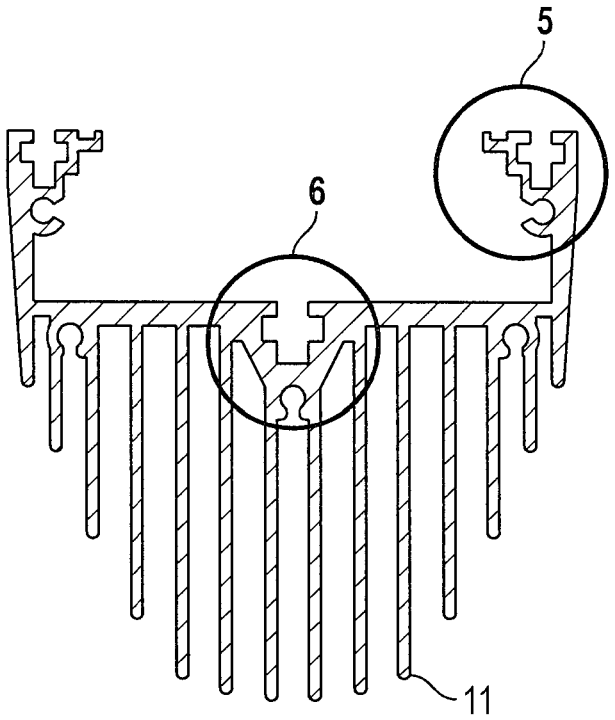
FIG. 4 illustrates a cross section with portions specified for detail in FIGS. 5 & 6.
Figure 5:
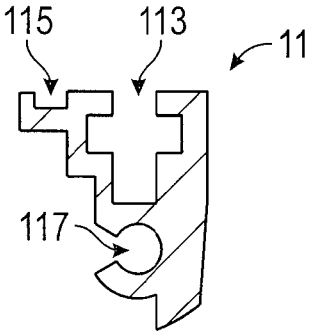
FIG. 5 illustrates detail from the perimeter ridge 11.
Figure 6:
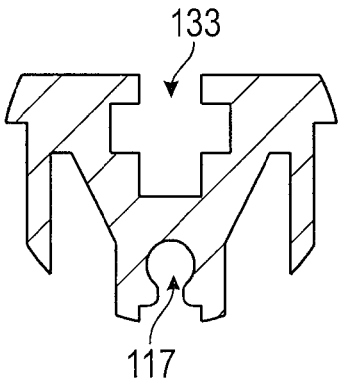
FIG. 6 illustrates detail from the backplane trough 133.

As illustrated in the cross sectional view of FIG. 4, the perimeter ridge 11 has a ridge height or longitudinal dimension between about one-half and one-fourth, and preferably about one-third of the height of the frame 1. A perimeter trough 113 is accessible beneath the top edge(s) of the perimeter ridge 11. As cross section of the perimeter trough 113 illustrated in FIG. 5 resembles a negative image of a "+" or "t" shape with five surfaces substantially parallel to the curved backplane 111 or top edge of the perimeter ridge 11 and six surfaces substantially perpendicular to the curved backplane 131 and top edges of the perimeter ridge 11. The preferred perimeter ridge 11 includes an O-ring channel 115 extending substantially perpendicularly from the perimeter ridge 11 towards the interior of the frame 1 and positioned adjacent the top edge of the perimeter ridge 11. The channel or trough 115 is adapted or sized to receive a rubber gasket or O-ring, which is compressed by the fixture lens mechanically coupled to the perimeter ridge 11 top edges by fasteners biased by the perimeter trough 113.

In one example of use, a plurality of LED modules are securable to the backplane 131 in equal or unequal rows, with equal or unequal numbers of LED modules. In this example, the LED modules each include an LED with encapsulate to refract light into a Lambertian pattern and may optionally include a lens suspended above or adhered to the encapsulate to refract light into a refracted beam pattern. A bonnet type reflector is positioned adjacently and above each LED 704 creating a reflected beam into a reflected beam pattern. The bonnet type reflector 702 is a curved concave shape and may be any shape that reflects light into a reflected beam pattern. The combination of the refracted beam pattern and reflected beam pattern from each LED module produces a combination refracted and reflected beam pattern directed away and substantially normally from the curved backplane 131 above or adjacent to which the LED module is positioned and secured. The plurality of LED modules produce a plurality of combination refracted and reflected beam patterns wherein each of the plurality of combination beam patterns is directed substantially normally from the curved backplane 131 above which each LED module is positioned and secured.

In another example, the plurality of LED modules omits either or both of the refracting lens or the reflecting lens. Still, the production of a plurality of beam patterns from each LED module is directed substantially normally to the backplane 131 to produce a light direction pattern correlated with the curvature of the backplane 131 of the frame 1. The beam pattern associated with each LED module creates a positive angle with respect to the beam pattern associated with LED modules adjacently located on the backplane 131. As a result, the light emitted from each LED module is cast at a positive angle with respect to the light emitted from adjacently located LED modules and the luminous intensity of light emitted from the frame 1 is substantially equivalent within the arc angle of the frame 1. The composite beam from the LED has a substantially consistent luminous intensity within the arc angle of the frame 1 as compared relative to a light fixture having a non-curved or substantially linear light fixture.

The illustrated frame 1 of FIG. 1 has a preferred arc angle "Θ" of between twenty degrees (20°) and forty five degrees (45°) and is preferably about thirty six degrees(36°) from one end of the frame 1 to the other. The frame 1 arc length is between about ten to fifteen times the arc height and preferably about twelve to thirteen times the arc height.

The electronics frame may be a die cast, die cast module, or made by extruding a radius light having the arc angle desired or extruding a straight or linear metal electronics frame, notching the fins in one or more places (to deter buckling of the metal fins), and bending or curving the frame to the desired curvature. Whether extruded or molded another preferred manner of constructing the frame 1 is by molding or extruding identical frame 1 segments having a curved dimension which are then fastened or secured together at the ends to create a completed frame 1 with the desired frame length and arc angle.

End caps 30 are secured to the ends of the frame 1 by inserting fasteners such as screws or bolts through the end caps 30 and into fastener receptacles 117 such as screw holes or threaded bolt apertures. The illustrated embodiment shows the fastener receptacles 117 positioned substantially directly beneath the backplane trough 133 and the perimeter trough 113. The end caps 30 are a unitary construction that are secured to the frame 1 ends include a mounting pivot such as a bolt extending substantially laterally from the frame and provide a mounting point for coupling the frame 1 to mounting hardware and access for the electrical conductor providing power to the interior of the fixture. To enclose the fixture, the end caps 30 are secured to the frame 1 and the protective lens 40 positioned across the frame 1. A plurality of longitudinally dimensioned rails (not shown) having a width substantially equivalent to the perimeter ridge are placed on top of the fixture lens and bolt type fasteners inserted into nuts positioned laterally in the perimeter trough 113 to engage the bolt type fasteners.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A vehicular light fixture, comprising:

a frame having a curved shape along a length of the frame, the frame including first and second sides, the first side having a substantially smooth surface that defines the curved shape and the second side having fins formed with the frame to define the curved shape, wherein the fins are configured to enable airflow to dissipate heat from the light fixture; and a plurality of light sources arranged along the first side, wherein the plurality of light sources are configured to project light radially away from the vehicular light fixture in a semi-circumferential pattern.

2. The light fixture of claim 1, wherein each of the plurality of light sources includes a light emitting diode.

3. The light fixture of claim 1, wherein each of the plurality of light sources is configured to emit light along an axis that is normal to the substantially smooth surface.

4. The light fixture of claim 1, wherein each of the plurality of light sources is configured to generate light in a direction that is different than a direction of light generated by any of the remaining plurality of light sources.

5. The light fixture of claim 1, wherein the curved shape exhibits an arc angle of between 10 and 50 degrees.

6. The light fixture of claim 1, further comprising:

a perimeter ridge configured to form a channel along a length of the frame; and a protective lens extending along a length of the perimeter ridge.

7. The light fixture of claim 6, wherein the plurality of light sources are displaced within the channel.

8. The light fixture of claim 6, wherein the protective lens is clear.

9. The light fixture of claim 6, wherein the perimeter ridge has a height of between about one-half and about one-fourth the height of the frame.

10. The light fixture of claim 6, wherein the perimeter ridge has a perimeter trough extending beneath a top edge of the perimeter ridge, the perimeter trough configured to be couple to the protective lens.

11. The light fixture of claim 6, wherein the perimeter ridge has a gasket channel extending from the top edge to receive a gasket for sealing the protective lens to the perimeter ridge.

12. The light fixture of claim 6, wherein a backplane trough extends beneath the channel to enable light sources and/or circuit boards to be secured within the channel.

13. The light fixture of claim 1, wherein the plurality of light sources are arranged in a single row.

14. The light fixture of claim 1, wherein the plurality of light sources are arranged in multiple rows.

15. The light fixture of claim 1, wherein the fins define the curved shape of the frame.

16. A vehicular light fixture, comprising:

a frame having a convex shape along a length of the frame, the frame including, a first side having a substantially smooth surface that is curved along the convex shape; and a second side opposing the first side, the second side having fins formed with the frame to define the curved shape, wherein the fins are configured to remove heat from the first side; and an array of light sources, wherein each light source of the array of light sources is coupled to a corresponding section of the first surface and the array of light sources is configured to emit light in a semi-circumferential pattern away from the convex shape.

17. The light fixture of claim 16, wherein each light source is configured to project light away from the light fixture in a direction that is normal to its corresponding section of the first surface.

18. The light fixture of claim 16, wherein each light source is configured to project light away from the light fixture in different directions as defined by the convex shape of the frame.

19. The light fixture of claim 16, wherein a curvature of the convex shape exhibits an arc angle of between 10 and 50 degrees.

20. The light fixture of claim 16, further comprising a reflector in proximity to each light source of the array of light sources.

21. The light fixture of claim 20, wherein the array of light sources and the reflectors produce a semi-circumferential beam pattern achieving a peak luminous intensity across the convex shape.

22. The light fixture of claim 16, further comprising a protective lens coupled to the frame.

23. The light fixture of claim 22, wherein the protective lens is clear.

24. The light fixture of claim 16, wherein the array of light sources are arranged in a single row.

25. The light fixture of claim 16, wherein the array of light sources are arranged in multiple rows.

26. The light fixture of claim 6, wherein the fins extend along the length of the frame.

27. The light fixture of claim 16, wherein an arc length of the frame is between about 10 and about 15 times an arc height of the frame.

28. A vehicular light fixture, comprising:

a frame having a curved shape along a length of the frame, the frame including first and second opposing sides, the first side having a substantially smooth surface that defines the curved shape and the second side having fins formed with the frame to define the curved shape, wherein the fins are configured to dissipate heat from the light fixture; and a plurality of light sources arranged along the first side, wherein the plurality of light sources are configured to project light radially away from the vehicular light fixture in a semi-circumferential pattern.

29. The light fixture of claim 28, wherein at least one fin extends the length of the frame.

* * * * *